US006675497B2

(12) United States Patent
Sedlbauer

(10) Patent No.: US 6,675,497 B2
(45) Date of Patent: Jan. 13, 2004

(54) WATERPROOF BOAT-LIKE SHELL FOR FOOTWEAR MADE BY CEMENT LASTING PROCESS

(76) Inventor: Stephen W. Sedlbauer, 2308 Hoover Court, Burlington, Ontario (CA), L7P 4V2

( * ) Notice: Subject to any disclaimer, the term of this patent is extended or adjusted under 35 U.S.C. 154(b) by 0 days.

(21) Appl. No.: 09/985,627

(22) Filed: Nov. 5, 2001

(65) Prior Publication Data

US 2002/0078594 A1 Jun. 27, 2002

(30) Foreign Application Priority Data

Dec. 27, 2000 (CA) ..... 2329625

(51) Int. Cl.[7] ..... A43B 1/10; A43B 13/32
(52) U.S. Cl. ..... 36/4; 36/14; 36/19.5
(58) Field of Search ..... 36/4, 14, 19.5, 36/12

(56) References Cited

U.S. PATENT DOCUMENTS 4,128,950 A * 12/1978 Bowerman et al. ..... 36/30 R
4,703,533 A * 11/1987 Barma ..... 36/4
5,189,814 A * 3/1993 Barma ..... 36/4
5,285,546 A * 2/1994 Haimerl ..... 36/12
5,384,971 A * 1/1995 Ferry ..... 36/105
5,659,914 A * 8/1997 Steinlauf ..... 36/12
5,664,343 A * 9/1997 Byrne ..... 36/55
5,685,091 A * 11/1997 Yalamanchili ..... 36/55
5,743,027 A * 4/1998 Barma ..... 36/4
5,784,808 A * 7/1998 Hockerson ..... 36/102

* cited by examiner

*Primary Examiner*—Ted Kavanaugh
(74) *Attorney, Agent, or Firm*—Riches, McKenzie & Herbert LLP

(57) ABSTRACT

A one-piece boat-like shell for footwear constructed from an injection-molded sole to which a last cemented upper is secured. The last cemented upper includes a vamp and heel counter each comprising a sheet of water impermeable vinyl secured about the periphery of a insole board and secured to the sole by a double bonding process.

6 Claims, 5 Drawing Sheets

FIG. 6.
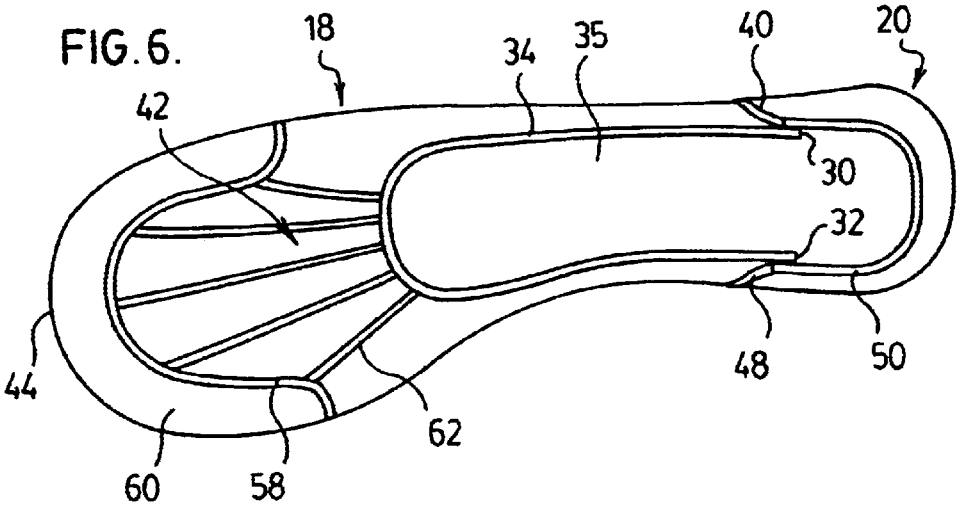
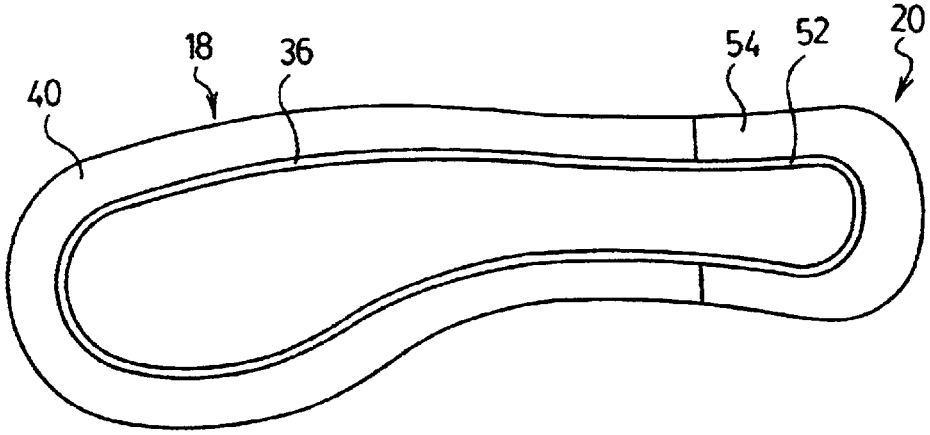
FIG. 7.
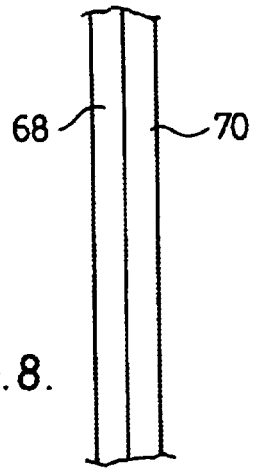
FIG. 8.

FIG.9.
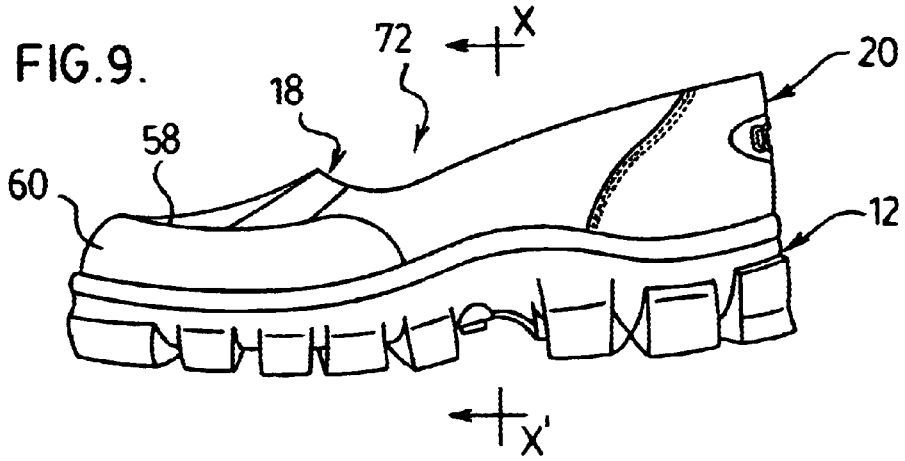
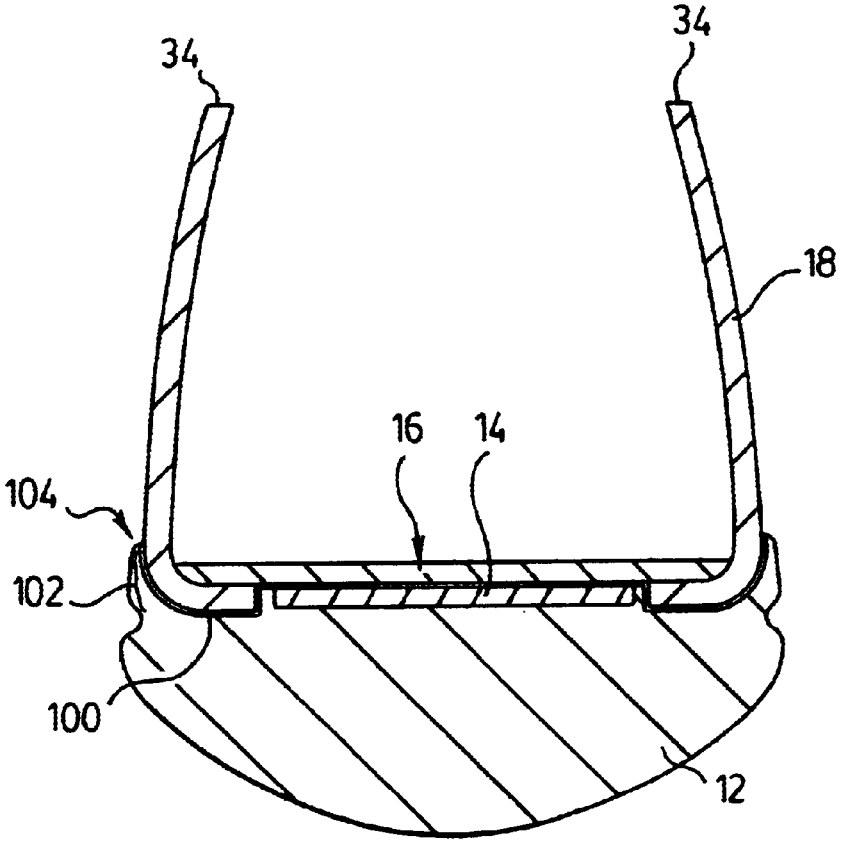
FIG.10.

WATERPROOF BOAT-LIKE SHELL FOR FOOTWEAR MADE BY CEMENT LASTING PROCESS

SCOPE OF THE INVENTION

This invention relates to footwear and, particularly, boots having a preferably waterproof boat-like shell.

BACKGROUND OF THE INVENTION

Footwear and particularly boots are known which have a one-piece boat-like shell comprising the sole, vamp and heel counter injection-molded as from rubber or plastic compounds and to which an upper may be attached. The one-piece boat-like shell effectively provides a waterproof lower-most portion of the boot which extends across the top of the toes upwardly to at least partially overlie the ball of a user's foot, preferably to the instep and rearwardly to about the heel. Such boots have been well received in the marketplace. However, they suffer the disadvantage that the same material is used for the sole as for the vamp and the heel and must be formed by the same process. A disadvantage of such boots as appreciated by the present inventor is that they do not permit the advantageous use of different materials for the sole, vamp and heel counter and do not permit use of different processes for manufacture and treating of the materials for these various portions of the boot.

SUMMARY OF THE INVENTION

To at least partially overcome these disadvantages of previously known devices, the present invention provides a construction for a footwear boat-like shell having an injection-molded sole of preferably lightweight rubber formed by injection-molding and to which an upper including a water impermeable vamp and heel counter formed to an insole board by a cement lasting process.

An object of the present invention is to provide a substitute for a conventional one-piece boat-like shell for footwear.

Another object is to provide a waterproof construction for footwear formed by a cement lasting.

Another object is to provide a boat-like shell for footwear formed with an injection-molded sole and a vamp and a heel counter of plastic, preferably vinyl, material carrying decorative markings thereon.

Another objective is to provide an improved method for construction of a waterproof boat-like shell for footwear.

BRIEF DESCRIPTION OF THE DRAWINGS

Further aspects and advantages of the present invention will become apparent from the following description taken together with the accompanying drawings in which:

FIG. 6 is a top view of the assembly shown in FIG. 3;

FIG. 7 is a bottom view of the assembly shown in FIG. 3, however, with the filler 14 shown in place;

FIG. 8 is a schematic cross-section of a segment of the vamp shown in FIG. 4;

FIG. 9 is a side view of an assembly of a boat-like shell; and

FIG. 10 is a cross-sectional view along line X–X' in FIG. 9.

DETAILED DESCRIPTION OF THE DRAWINGS

Figure 1:
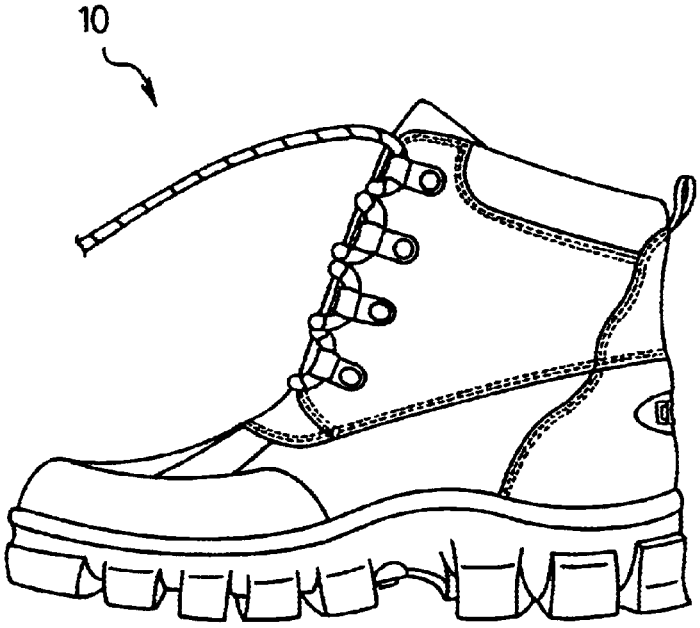
FIG. 1 is a pictorial view of a first preferred embodiment of a boot in accordance with the present invention.

Reference is made first to FIG. 1 which shows an assembled boot 10 in accordance with the first embodiment of the present invention.

Figure 2:
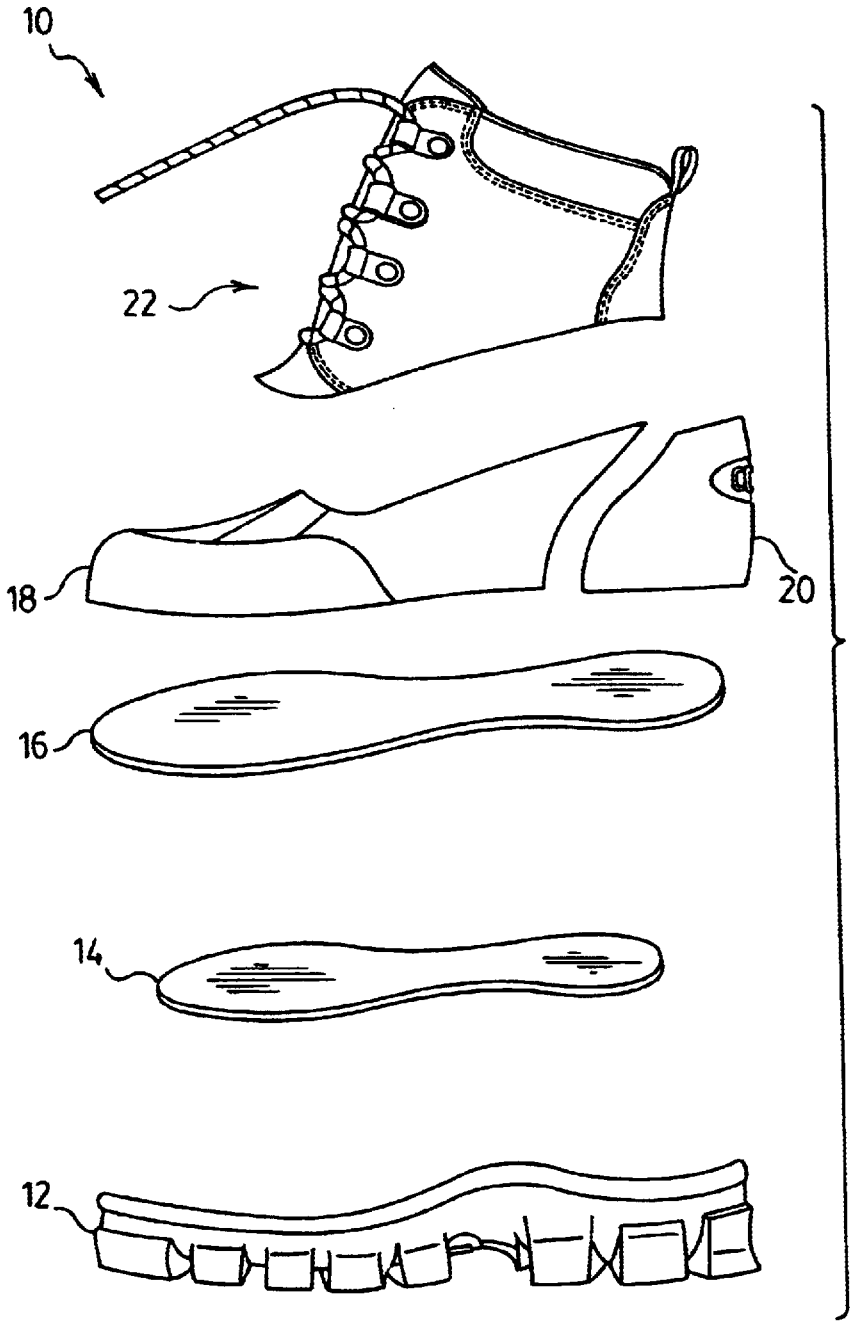
FIG. 2 is a schematic exploded side view showing selected components of the boot of FIG. 1.

FIG. 2 shows in a schematic exploded view various components of the boot. These components include a sole 12, a filler 14, an insole board 16, a vamp 18, a heel counter 20 and an upper generally indicated 22.

Figure 4:
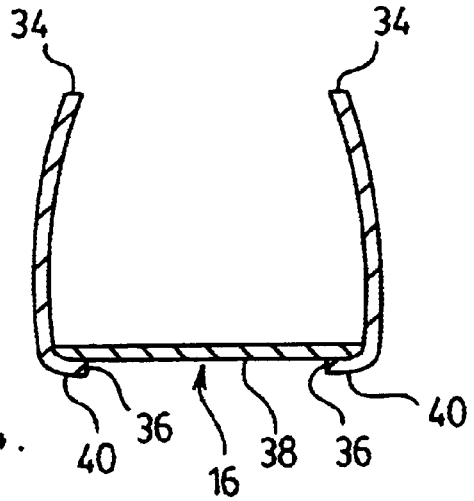
FIG. 4 is a cross-sectional view along line 4–4' of FIG. 3.
Figure 5:
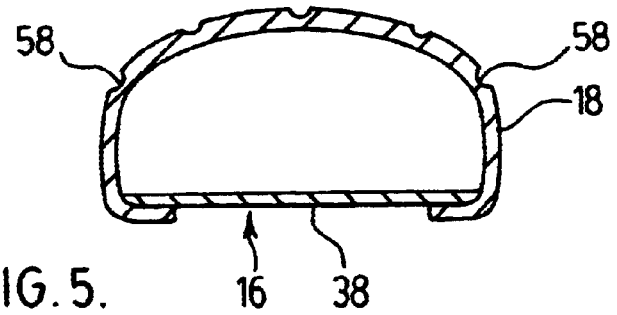
FIG. 5 is a cross-sectional view along line 5–5' in FIG. 3.

The vamp 18 comprises a sheet member which is formed into a generally U-shape as seen in FIG. 6 extending from one rear edge 30 to a second rear edge 32 on opposite sides. An upper edge 34 is of a U-shape and defines a major portion of an opening to receive a user's foot therethrough. As best seen in FIGS. 4, 5 and 7, a lower edge 36 of the vamp 18 wraps underneath the lower surface 38 of the insole board 16 and is secured thereto. The vamp 18 thus has a lasting allowance flange 40 which is provided underneath the insole board 16 and extends about the periphery of the insole board from one rear edge 30 to the other rear edge 32 of the vamp.

The vamp is shown to have a toe portion 42 which extends from the front toe 44 of the vamp over an upper portion of a foot of a user to the upper edge 34. At the forwardmost portion of the upper edge 34, the vamp preferably extends sufficiently high so that the toe portion 42 extends rearwardly to provide continuous cover and preferably waterproofing over the toe at least rearward of a ball of a foot and preferably rearward to proximate where an instep commences.

The heel counter 20 comprises a sheet material which, as seen in FIG. 6, extends in a general U-shape from a front edge 46 on one side to a front edge 48 on the other side. The heel counter 20 extends upwardly to an upper edge 50 and downwardly to a lower edge 52. The lower edge 52 is underneath the insole board 16 and a lasting allowance flange 54 is provided as part of the heel counter which extends underneath the insole board 16 and is bonded thereto.

Figure 3:
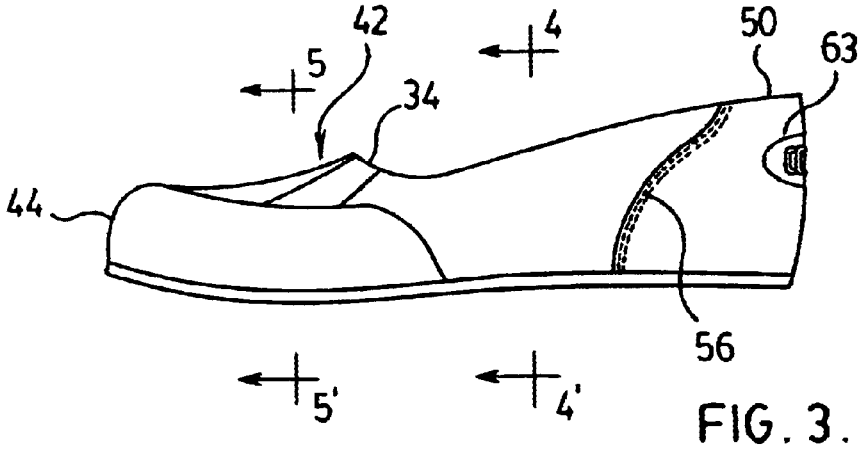
FIG. 3 is a side view of an assembly of the insole board, vamp and heel counter.

On each side of the assembly shown in FIG. 3, the vamp 18 is secured to the heel counter 20 as along a stitched line shown at 56 in FIG. 3. This stitched line preferably is formed by stitching the materials together and applying sealants preferably to an inside of the stitching sufficient to waterproof the seam and its stitching.

Each of the vamp 18 and heel counter 20 are preferably formed with a sheet-like material forming their exterior surface, which sheet-like material can permanently carry surface contours such as deformations therein or ridges thereon which provide a pleasing, decorative appearance. In this regard, as best seen in FIG. 5, the vamp is provided with a series of shallow grooves therein which provide a pleasing appearance. In the particular embodiment shown in the grooves include a groove 58 which delineates an imitation toe counter portion 60. Further, a plurality of decorative grooves 62 extend radially inwardly from the groove 58 to the upper edge 34 to provide a decorative appearance.

In a somewhat similar manner, the exterior surface of the heel counter 20 carries an oval depression 63 and raised lettering therein representing a trade mark of the boot manufacture provide the manner of grooves and/or a relief permanently formed in the exterior surface of the heel counter.

Each of the vamp 18 and heel counter 20 preferably have an outer sheet which comprises a plastic material. The plastic material may be selected from vinyl, urethane, rubber and other plastic materials and composites and copolymers thereof. The plastic material preferably is waterproof in the sense of preventing water and moisture to pass therethrough and not retaining water therein. Preferred of such materials is vinyl. The surface of the outer sheet, preferably vinyl material, is preferably treated by being passed through a roller which removes a previously existing surface from the vinyl material so as to provide an altered surface, preferably an embossed surface. The surface is preferably selected to have a surface similar to that of leather or suede-like material with slight indentations and giving a slightly distressed look similar to that of suede or leather. Preferably the surface is not shiny. The outer sheet preferably must be selected such that after treating the surface, the material is waterproof.

Grooves 58 and 62 are preferably permanently imprinted using a high frequency welding technique under which high frequency sound waves are directed into the vinyl at a time when the vinyl is being deformed by a printing plate or roller so as to permanently deform the outer vinyl layer with the groove, surface detail etchings, patterns, relief, embroidering and the like. As well, decorative features such as false stitching lines or joining seams may be formed. Other decorative features can be provided such as raised areas and ribs and the like.

Each of the vamp 18 and heel counter 20 preferably comprise a laminate having a preferred outer layer of vinyl material. Preferably, inner layers of reinforcement and/or insulation materials may be provided secured as an inner layer of the vamp and heel counter. FIG. 8 shows an enlarged cross-section of the vamp showing an outer layer of vinyl material 68 and an inner layer of backing material 70.

In accordance with the present invention, the vamp 18 and heel counter 20 are formed to have preferred grooves and surface texture. In a cement lasting process, the insole board 16 is placed on a last and the vamp 18 and heel counter 20 are secured to the insole board 14 as by adhering the flanges 40 and 54 to the under surface 38 of the insole board 16. Subsequently, an assembly including the insole board 16, vamp 18 and heel counter 20 are placed on the sole 12 sandwiching the filler 14 therebetween.

The insole board 16 and filler 14 are preferably secured to the sole 12 by a double bonding process in which a layer of water impermeable sealing and/or adhesive compound is provided as a continuous layer schematically shown as 100 in FIG. 10 over the entire lower surface of the lasting allowance flanges 40 and 54 of the vamp and counter and over the entirety of the lower surface 38 of the insole board 16 so as, for example, to provide a impermeable seal against water passing through the composite structure formed by the insole board 16, vamp 18 and heel counter 20. In addition, additional cementing is provided as a continuous secondary seal area, bead or joint 102 about the periphery of the sole 12 where an upper rim 104 of the sole 12 merges with the vamp 18 and heel counter 20 circumferentially about the sole 12 as seen in FIG. 10.

FIG. 9 shows a resultant assembly comprising a boat-like shell 72 which may be produced as a composite of the sole 12, filler 14, insole board 16, vamp 18 and heel counter 20. While the insole board 16, vamp 18 and heel counter 20 are joined by a cement lasting process by the use of a water impermeable injected rubber sole 12, a water impermeable vinyl sheeting for each of the vamp 18 and heel counter 20 and with providing for water impermeable joining of the vamp 18 to the heel counter 20 and water impermeable joining of the vamp 18 and heel counter 20 to the sole 12 as well as the preferred undercoating of the flange portions of the vamp and heel counter and the under surfaces of the insole board 16 with waterproof surface coating adhesives, the boat-like shell comprises effectively a waterproof vessel made by the cement lasting process. This waterproof boat-like shell may preferably comprise a lower portion of a footwear which may adopt and have varying uppers which may be laced or slide on or may be of varying heights. The boat-like shell will be used with a shaft or collar which extends upwardly as in a manner of the boot shown or may be very shallow as in the manner of providing a slipper or the like.

The novel selection of the particular elements of construction, namely, the relatively lightweight injection-molded sole, the vinyl vamp and vinyl heel counter carrying a decorative surface and decorative grooves therein provide for a novel construction which is relatively inexpensive to manufacture yet can be perfectly waterproof and has the appearance of the well known accepted one-piece boat-like shells.

While the vamp 18 is shown as one piece as is preferred to reduce seams which must be waterproofed, the vamp 18 may comprise a number of pieces of sheet material as with a separate toe counter or pieces between.

Many modifications and variations of the invention will now occur to persons skilled in the art. For a definition of the invention, reference is made to the appended claims.

What is claimed is:

1. An article of footwear comprising a sole, a vamp, a heel counter and an insole board, the sole comprising a water impermeable unitary member formed by injection molding, the vamp and heel counter each having an interior surface and an exterior surface with the exterior surface formed by a sheet of water impermeable plastic material, the insole board having a lower surface and a perimeter thereabout, the vamp and heel counter secured to the insole board to extend upwardly from the perimeter of the insole board and with flange portions of each of the vamp and heel counter folded to extend under the insole board, to an inner peripheral edge of the flange portions and with the interior surfaces of the flange portions secured to the lower surface of the insole board, a continuous layer of water impermeable sealant over the exterior surfaces of the flange portions under the insole board and over the lower surface of the insole board inwardly of the flange portions to seal the lower surface of the insole board and junctures between the insole board and the inner peripheral edge of the flange portions against water penetration, the sole having a continuous circumferential upper rim in engagement with and encircling the vamp and counter, a continuous joint of water impermeable adhesive joining the upper rim of the sole to the exterior surfaces of the vamp and heel counter continuously circumferentially about the rim, the vamp having a toe portion extending over the toes and upper portion of the foot to enclose toes and an upper portion of a foot received in the footwear rearwardly from the toes at least rearward to above a ball of the foot.

2. An article of footwear as claimed in claim 1 wherein the sheet of plastic material is vinyl, the exterior surface of the sheet having surface contours defined therein.

3. An article of footwear as claimed in claim 2 wherein the surface contours comprise a relief which provide an appearance of a toe counter formed on the vamp.

4. An article of footwear as claimed in claim 2 wherein the surface contours comprise grooves which delineate a toe portion of the vamp about the toe from the remainder of the vamp and providese the toe portion with an appearance of a toe counter formed on the vamp.

5. An article of footwear as claimed in claim 1 wherein said sealant comprises a water impermeable adhesive which bonds the flange portion to the sole.

6. An article of footwear as claimed in claim 5 wherein the continuous joint is circumferentially about a periphery of the continuous layer.

* * * * *